US010174273B2

(12) United States Patent
Zhang et al.

(10) Patent No.: US 10,174,273 B2
(45) Date of Patent: Jan. 8, 2019

(54) FABRIC SOFTENER COMPOSITION

(71) Applicant: RHODIA OPERATIONS, Paris (FR)

(72) Inventors: Hai Zhou Zhang, Singapore (SG); Lin He, Singapore (SG); William Zhan, Singapore (SG)

(73) Assignee: Rhodia Operations, Paris (FR)

( * ) Notice: Subject to any disclaimer, the term of this patent is extended or adjusted under 35 U.S.C. 154(b) by 0 days.

(21) Appl. No.: 15/037,893

(22) PCT Filed: Nov. 20, 2014

(86) PCT No.: PCT/EP2014/075072
§ 371 (c)(1),
(2) Date: May 19, 2016

(87) PCT Pub. No.: WO2014/075097
PCT Pub. Date: May 28, 2015

(65) Prior Publication Data

US 2016/0289602 A1 Oct. 6, 2016

(30) Foreign Application Priority Data

Nov. 20, 2013 (WO) ..... PCT/EP2013/075072

(51) Int. Cl.

| | |
|---|---|
| ***C11D 1/90*** | (2006.01) |
| ***C11D 1/75*** | (2006.01) |
| ***C11D 1/88*** | (2006.01) |
| ***C11D 3/00*** | (2006.01) |
| ***C11D 3/20*** | (2006.01) |
| ***C11D 3/22*** | (2006.01) |

(52) U.S. Cl.
CPC ..... *C11D 1/90* (2013.01); *C11D 1/75* (2013.01); *C11D 1/88* (2013.01); *C11D 3/0015* (2013.01); *C11D 3/202* (2013.01); *C11D 3/2013* (2013.01); *C11D 3/2031* (2013.01); *C11D 3/2075* (2013.01); *C11D 3/2079* (2013.01); *C11D 3/222* (2013.01)

(58) Field of Classification Search
CPC ..... C11D 1/90; C11D 1/88; C11D 3/0015; C11D 3/2013; C11D 3/222
See application file for complete search history.

(56) References Cited

U.S. PATENT DOCUMENTS

| | | | | |
|---|---|---|---|---|
| 4,360,437 | A | 11/1982 | Wolfes | |
| 4,855,072 | A | 8/1989 | Trinh et al. | |
| 5,942,477 | A | 8/1999 | Giret et al. | |
| 5,994,280 | A | 11/1999 | Giret et al. | |
| 6,906,015 | B1 * | 6/2005 | Shiloach ..... | C11D 1/008 510/119 |
| 2003/0147822 | A1 | 8/2003 | Doi et al. | |
| 2006/0094635 | A1 * | 5/2006 | Pereira ..... | A61K 8/042 510/470 |

FOREIGN PATENT DOCUMENTS

| | | | |
|---|---|---|---|
| EP | 0369500 | A2 | 5/1980 |
| EP | 0018039 | A1 | 10/1980 |
| WO | 9414935 | A1 | 7/1994 |
| WO | 9429418 | A1 | 12/1994 |
| WO | 9742279 | A1 | 11/1997 |
| WO | 2002072745 | A1 | 9/2002 |
| WO | 2004044113 | A2 | 5/2004 |
| WO | 2006105991 | A1 | 10/2006 |

OTHER PUBLICATIONS

Response under 37 CFR §1.116—Application Is in Condition for Allowance in connection with U.S. Appl. No. 14/780,273, filed Mar. 7, 2017.
Notice of Allowance in connection with U.S. Appl. No. 14/780,273 dated Mar. 24, 2017.

* cited by examiner

*Primary Examiner* — John R Hardee
(74) *Attorney, Agent, or Firm* — Jarrod N. Raphael

(57) ABSTRACT

The present invention then concerns a fabric softener composition that performs well on softening fabrics, which comprises a blend of amphoteric surfactant carrying a $C_{12}$-$C_{22}$-alkyl or $C_{12}$-$C_{22}$-alkenyl, a fatty acid or a fatty alcohol, and a polysaccharide or polysaccharide derivative. The invention also concerns the use of said softening composition to impart fabric softness to fabrics.

5 Claims, No Drawings

FABRIC SOFTENER COMPOSITION

This application claims priority to PCT international application no. PCT/EP2013/074311 filed on Nov. 20, 2013, the whole content of this application being incorporated herein by reference for all purposes.

The present invention then concerns a fabric softener composition that performs well on softening fabrics, which comprises a blend of amphoteric surfactant carrying a $C_{12}$-$C_{22}$-alkyl or $C_{12}$-$C_{22}$-alkenyl, a fatty acid or a fatty alcohol, and a polysaccharide or polysaccharide derivative. The invention also concerns the use of said softening composition to impart fabric softness to fabrics.

PRIOR ART

The following discussion of the prior art is provided to place the invention in an appropriate technical context and enable the advantages of it to be more fully understood. It should be appreciated, however, that any discussion of the prior art throughout the specification should not be considered as an express or implied admission that such prior art is widely known or forms part of common general knowledge in the field.

Fabric care compositions deliver a number of desirable characteristics to fabrics upon treatment, including an improved fabric feel and a perception of freshness. However, in order to secure high consumer acceptance of any fabric care composition, it is essential to provide consumer-desirable product aesthetics, for example not only an appealing neat product odor and a pleasant product color, but especially an appropriate product rheology and satisfactory physical product stability.

Preferred fabric softener actives according to WO-A-02072745 are esterquats such as N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2-hydroxyethyl) N-methyl ammonium methylsulfate or 1,2-di(stearoyl-oxy)-3-trimethyl ammoniumpropane chloride.

There is an abundant bibliography on the subject of combining dialkyl substituted quaternary ammonium compounds and monoalkyl quaternary ammonium compounds, amongst which patents or patent applications EP-A-0018039, EP-A-0369500, U.S. Pat. No. 4,360,437 or U.S. Pat. No. 4,855,072 amongst many others, may be mentioned.

References describing mixtures of dialkyl substituted esterquats and monoalkyl esterquats are WO-A-9414935, WO-A-9742279, WO-A-2004044113 amongst many others.

However, quats are known as very difficult to be biodegradable and provide confirmed eco toxicity, and it exists a general trend for this industry is to switch to esterquats, which provide better biodegradability and better eco toxicity. But even ester quats provides still some disadvantages as a not so long term stability in the final product due to a degradability that imposes to keep a very low pH in order to make it more stable. Moreover, fabric turns to yellowish when they are treated repeatedly by ester quats. Ester quats are also known as cationic surfactants that can not be mixed directly with most of the anionic detergent system.

INVENTION

The present invention is based on the surprising discovery that it is possible to obtain a stable fabric softener composition that performs well on softening fabrics, which comprises a blend of amphoteric surfactant carrying a $C_{12}$-$C_{22}$-alkyl or $C_{12}$-$C_{22}$-alkenyl, preferably a $C_{16}$-$C_{20}$-alkyl or $C_{16}$-$C_{20}$-alkenyl, a fatty acid or a fatty alcohol, and a polysaccharide or polysaccharide derivative.

These compounds indeed appear to be sufficiently efficient and notably more efficient in term of softness, water absorbency and fluffiness, in comparison with the compounds classically used in the softening compositions such as di(palmiticcarboxyethyl) hydroxyethyl methyl ammonium methylsulfate (TEP), and Dimethyl di(hydrogenated tallow) ammonium chloride (DHT).

These compounds also provide the advantages to be more stable over time and different pH range, and provide a good compatibility with all other surfactants system.

The present invention then concerns a softening composition, such as a fabric softener composition, comprising at least:

a) 1-10% wt of an amphoteric surfactant carrying a $C_{12}$-$C_{22}$-alkyl or $C_{12}$-$C_{22}$-alkenyl;

b) 0.1-5% wt of an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl; weight ratio of compound a) to compound b) is comprised between 1:2 and 20:1;

c) 0.01-2% wt of a polysaccharide or polysaccharide derivative; weight ratio of compound a) to compound c) is comprised between 3:1 and 30:1; and d) water;

percent by weight expressed in relation with the total weight of the composition.

The present invention also concerns a softening composition, such as a fabric softener composition, comprising at least:

a) 1-10% wt of an amphoteric surfactant carrying a $C_{16}$-$C_{20}$-alkyl or $C_{16}$-$C_{20}$-alkenyl;

b) 0.1-5% wt of an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl; weight ratio of compound a) to compound b) is comprised between 1:2 and 20:1;

c) 0.01-2% wt of a polysaccharide or polysaccharide derivative; weight ratio of compound a) to compound c) is comprised between 3:1 and 30:1; and d) water;

percent by weight expressed in relation with the total weight of the composition.

The present invention also concerns a softening composition, such as a fabric softener composition, comprising at least:

a) 1-10% wt of an amphoteric surfactant carrying a $C_{16}$-$C_{20}$-alkyl or $C_{16}$-$C_{20}$-alkenyl;

b) 0.1-5% wt of an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl; weight ratio of compound a) to compound b) is comprised between 1:2 and 20:1;

c) 0.01-2% wt of a polysaccharide or polysaccharide derivative; weight ratio of compound a) to compound c) is comprised between 3:1 and 30:1; and d) water;

wherein the softening composition is substantially free or completely free of anionic agent; percent by weight expressed in relation with the total weight of the composition.

The present invention also concerns a softening composition, such as a fabric softener composition, consisting of:

a) 1-10% wt of an amphoteric surfactant carrying a $C_{16}$-$C_{20}$-alkyl or $C_{16}$-$C_{20}$-alkenyl;

b) 0.1-5% wt of an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl; weight ratio of compound a) to compound b) is comprised between 1:2 and 20:1;

c) 0.01-2% wt of a polysaccharide or polysaccharide derivative; weight ratio of compound a) to compound c) is comprised between 3:1 and 30:1; and d) water;

percent by weight expressed in relation with the total weight of the composition.

The present invention also concerns a softening system consisting of:

a) an amphoteric surfactant carrying a $C_{12}$-$C_{22}$-alkyl or $C_{12}$-$C_{22}$-alkenyl;

b) an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl;

weight ratio of compound a) to compound b) is comprised between 1:2 and 20:1, and c) a polysaccharide or polysaccharide derivative; weight ratio of compound a) to compound c) is comprised between 3:1 and 30:1.

The present invention also concerns a softening system consisting of:

a) an amphoteric surfactant carrying a $C_{16}$-$C_{20}$-alkyl or $C_{16}$-$C_{20}$-alkenyl;

b) an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl;

weight ratio of compound a) to compound b) is comprised between 1:2 and 20:1, and c) a polysaccharide or polysaccharide derivative; weight ratio of compound a) to compound c) is comprised between 3:1 and 30:1.

The present invention also concerns the use of said softening composition, or said softening system, to impart fabric softness to fabrics.

The present invention also concerns the use of said softening composition, or said softening system, as a textile care agent.

DETAILS OF THE INVENTION

In the context of this invention, "textile care agent" is understood to mean both washing and cleaning agents and pretreatment agents, as well as agents for conditioning textile fabrics such as delicate fabric washing agents, and post-treatment agents such as conditioners.

In the context of this invention as well, "softening composition" or "fabric softener composition" are to be understood for purposes of this invention as the softening treatment of textile fabrics, materials, yarns, and woven fabrics. Softening imparts positive properties to the textiles, for example improved softness, enhanced shine and color brilliance, a fresh scent, and a decrease in creasing and static charge.

"Alkyl" as used herein means a straight chain or branched saturated aliphatic hydrocarbon. "Alkenyl", as used herein, refers to an aliphatic group containing at least one double bond and is intended to include both "unsubstituted alkenyls" and "substituted alkenyls", the latter of which refers to alkenyl moieties having substituents replacing a hydrogen on one or more carbon atoms of the alkenyl group.

Throughout the description, including the claims, the term "comprising one" should be understood as being synonymous with the term "comprising at least one", unless otherwise specified, and "between" should be understood as being inclusive of the limits.

The term amphoteric surfactants or zwitterionic surfactants are well-known to the person skilled in the art. It refers to surfactants which, depending on the pH, have anionic and/or cationic properties. They also have an isoelectric point at which they possess a zwitterionic character. In particular, the term refers to compounds having an $N^+$ function in combination with an $O^-$, C(O)OH, $C(O)O^-$, $SO_3H$ or $SO_3^-$ function and to compounds having an N function in combination with a C(O)OH, $C(O)O^-$, $SO_3H$ or $SO_3^-$ function. More in particular, it refers to compounds having an $N^+$—$O^-$ function, a quaternary $N^+$ function in combination with a $C(O)O^-$, $SO_3H$ or $SO_3^-$ function, and to compounds having a tertiary N function in combination with a C(O)OH, $C(O)O^-$, $SO_3H$ or $SO_3^-$ function.

For an overview of amphoteric surfactants and their properties the reader is referred to Amphoteric Surfactants, 2*nd* ed., E. G. Lomax, Ed., 1996, Marcel Dekker. This class of surfactants includes betaines, e.g., fatty alkyl betaines, fatty alkylamido betaines, sulfobetaines, hydroxysulfobetaines, and betaines derived from imidazolines; amine oxides, e.g., fatty alkylamine oxides and fatty alkylamido amine oxides; amphoglycinates and amphopropionates; and so-called "balanced" amphopoly-carboxyglycinates and amphopolycarboxypropionates.

The amphoteric surfactants may carry a $C_{12}$-$C_{22}$-alkyl or $C_{12}$-$C_{22}$-alkenyl, more preferably, the amphoteric surfactants carry a $C_{16}$-$C_{20}$-alkyl or $C_{16}$-$C_{20}$-alkenyl. The amphoteric surfactants may be chosen in the group consisting of: betaine, amine oxide, amphoglycinate and amphopropionate.

Betaines are a class of amphoteric surfactants which include compounds having the structure:

$$R^1R^2R^3N^+(CH_2)_yC(O)O^- \quad \text{(I)}$$

or $$(R^1)(R^2C(O)NH(CH_2)_x)(R^3)N^+(CH_2)_yC(O)O^- \quad \text{(II)}$$

wherein $R^1$ is a $C_1$-$C_5$ group which is optionally hydroxylated, such as a methyl, ethyl, hydroxyethyl, or hydroxypropyl group, $R^2$ is $C_{12}$-$C_{22}$-alkyl or $C_{12}$-$C_{22}$-alkenyl, $R^3$ is independently selected from a $C_1$-$C_5$ group or $C_{12}$-$C_{22}$-alkyl or $C_{12}$-$C_{22}$-alkenyl as defined for $R^1$ and $R^2$, respectively, x is 2-4, and y is 2-4, and wherein any two of the groups $R^1$-$R^3$ optionally may form a ring structure. $C_1$-$C_5$ group may be an alkyl or alkenyl group. Preferably, $R^2$ is $C_{16}$-$C_{20}$-alkyl or $C_{16}$-$C_{20}$-alkenyl. Preferably, $R^3$ is selected from a $C_1$-$C_5$ group or $C_{16}$-$C_{20}$-alkyl or $C_{16}$-$C_{20}$-alkenyl.

In the context of the present invention, betaine also includes sulfobetaines and hydroxysulfobetaines which have structures according to (I) and (II), having $R^1$, $R^2$, and $R^3$ defined as above, wherein the group $(CH_2)_yC(O)O^-$ has been replaced by a $C_{3-4}$—$SO_3^-$ group, in which $C_3$-$C_4$ group is optionally hydroxylated.

Amine oxides are a class of amphoteric surfactants which include compounds having the structure:

$$R^1R^2R^3N^+—O^- \quad \text{(III)}$$

or $$(R^1)(R^2C(O)NH(CH^2)_x)(R^3)N^+—O^- \quad \text{(IV)}$$

wherein $R^1$, $R^2$, and $R^3$ and x have the meaning described above.

Amphoglycinates (z=1) and amphopropionates (z=2) are a class of amphoteric surfactants which include compounds having the structures:

$$R^2N(R^4)(CH_2)_zC(O)O^-Y^+ \quad (V)$$

and $$R^2C(O)N(R^4)(CH_2)xN(R^5)(CH_2)_zC(O)O^-Y^+ \quad (VI)$$

wherein $R^2$ and x have the meaning described above, $R^4$ is hydrogen or a $C_1$-$C_5$ group which is optionally hydroxylated, $R^5$ is a $C_1$-$C_5$ group which is optionally hydroxylated or a $(CH_2)_z$ $C(O)O^-$ group, z is 1-4, and $Y^+$ is a cation, such as a proton or a sodium ion.

More preferably, the amphoteric surfactant of the present invention is a compound of formula (VII):

$$R^2—N^+(CH_3)_2—CH_2—COO^- \quad (VII)$$

wherein $R^2$ is $C_{12}$-$C_{22}$-alkyl or $C_{12}$-$C_{22}$-alkenyl.

Preferably $R^2$ is $C_{16}$-$C_{22}$-alkyl, such as $C_{16}$-alkyl, $C_{18}$-alkyl, $C_{20}$-alkyl and $C_{22}$-alkyl. Preferably $R^2$ may also be $C_{16}$-$C_{22}$-alkenyl, such as $C_{16}$-alkenyl, $C_{18}$-alkenyl, $C_{20}$-alkenyl and $C_{22}$-alkenyl. More preferably, $R^2$ is $C_{16}$-$C_{20}$-alkyl, such as $C_{16}$-alkyl, $C_{18}$-alkyl and $C_{20}$-alkyl or $C_{16}$-$C_{20}$-alkenyl, such as $C_{16}$-alkenyl, $C_{18}$-alkenyl and $C_{20}$-alkenyl.

In a preferred embodiment of the present invention, the compound of formula (VII) is chosen in the group constituted of: cetyl betaine, palmityl betaine, stearyl betaine and oleyl betaine. More preferably, the compound of formula (VII) is cetyl betaine.

It has to be outlined that the composition of the present invention may comprise an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl.

Preferably, the $C_{10}$-$C_{22}$-alkyl or $C_{10}$-$C_{22}$-alkenyl carboxylic acids are chosen in the group consisting of: capric acid, lauric acid, myristic acid, palmitic acid, stearic acid, arachidic acid and behenic acid.

Preferably, the $C_{10}$-$C_{22}$-alkyl or $C_{10}$-$C_{22}$-alkenyl alcohols are chosen in the group consisting of: capryl alcohol, lauryl alcohol, myrityl alcohol, palmityl alcohol, stearyl alcohol, arachidyl alcohol and behenyl alcohol.

Weight ratio of compound a) to compound b) may be comprised between 1:2 and 20:1, notably between 1:1 and 10:1, more preferably between 1:1 and 2.5:1.

The softening composition may also comprise at least a polysaccharide or a polysaccharide derivative (also referred to as "compound c)"). Compound c) is preferably chosen in the group consisting of: guar, cellulose, callose, xylan, mannan, galactomannan, and derivatives thereof.

Preferred polysaccharides are nonionic or cationic guars.

Nonionic guars are generally non modified guars, which mean a polysaccharide composed of the sugars galactose and mannose. The backbone is a linear chain of β 1,4-linked mannose residues to which galactose residues are 1,6-linked at every second mannose, forming short side-branches.

Cationic guars may include cationic guars that may be obtained by the use of different possible cationic etherifying agents, such as for example the family of quaternary ammonium salts.

In the case of cationic guars, the cationic group may be then a quaternary ammonium group bearing 3 radicals, which may be identical or different, preferably chosen from hydrogen, alkyl, hydroxyalkyl, epoxyalkyl, alkenyl, or aryl, preferably containing 1 to 22 carbon atoms, more particularly 1 to 14 and advantageously 1 to 3 carbon atoms. The counter ion is generally a halogen, which in one embodiment is chlorine.

Quaternary ammonium salts may be for example: 3-chloro-2-hydroxypropyl trimethyl ammonium chloride (CHPTMAC), 2,3-epoxypropyl trimethyl ammonium chloride (EPTAC), diallyldimethyl ammonium chloride (DMDAAC), vinylbenzene trimethyl ammonium chloride, trimethylammonium ethyl metacrylate chloride, methacrylamidopropyltrimethyl ammonium chloride (MAPTAC), and tetraalkylammonium chloride.

A typical cationic functional group in these cationic guar derivatives is trimethylamino(2-hydroxyl)propyl, with a counter ion. Various counter ions can be utilized, including but not limited to halides, such as chloride, fluoride, bromide, and iodide, sulfate, methylsulfate, and mixtures thereof.

Cationic guars of the present invention may be chosen in the group consisting of:

- cationic hydroxyalkyl guars, such as cationic hydroxyethyl guar (HE guar), cationic hydroxypropyl guar (HP guar), cationic hydroxybutyl guar (HB guar), and
- cationic carboxylalkyl guars including cationic carboxymethyl guar (CM guar), cationic alkylcarboxy guars such as cationic carboxylpropyl guar (CP guar) and cationic carboxybutyl guar (CB guar), carboxymethylhydroxypropyl guar (CMHP guar).

More preferably, cationic guars of the invention are guars hydroxypropyltrimonium chloride or hydroxypropyl guar hydroxypropyltrimonium chloride.

The degree of hydroxyalkylation (molar substitution or MS) of cationic guars, that is the number of alkylene oxide molecules consumed by the number of free hydroxyl functions present on the guar, may be comprised between 0 and 3, preferably between 0 and 1.7. As example, a MS of 1 may represent one ethylene oxide unit per monosaccharide unit.

The Degree of Substitution (DS) of cationic guars, that is the average number of hydroxyl groups that have been substituted by a cationic group per hydroxyl group per sugar, may be comprised between 0.005 and 1, preferably between 0.01 and 1. DS may notably represent the number of the carboxymethyl groups per monosaccharide unit. DS may notably be determined by titration.

The Charge Density (CD) of cationic guars may be comprised between 0.1 and 2 meq/g, preferably between 0.4 and 1 meq/g. The charge density refers to the ratio of the number of positive charges on a monomeric unit of which a polymer is comprised to the molecular weight of said monomeric unit. The charge density multiplied by the polymer molecular weight determines the number of positively charged sites on a given polymer chain.

The cationic guar may have an average Molecular Weight (Mw) of between about 100,000 daltons and 3,500,000 daltons, preferably between about 500,000 daltons and 3,500,000 daltons.

In one embodiment, weight ratio of compound a) to compound c) in the softening composition may be comprised between 3:1 and 30:1, preferably between 5:1 and 25:1, more preferably between 10:1 and 20:1.

The softening composition of the present invention may comprise between 0.1 and 1% by weight of compound b), in relation with the total weight of the composition.

Preferably, the softening composition is substantially free or completely free of anionic agent. Addition of anionic agent(s) may lead to foam forming which is not desired for the present invention, and may negatively affect the softening performance of the composition. As used herein, the term "substantially free" when used with reference to the absence of anionic agent in the composition of the present invention, means that the composition comprises less than 0.1 wt % of the anionic agent, more preferably less than 0.01 wt % of the anionic agent, based on the total weight of the composition. As used herein, the term "completely free" when used with reference to the absence of the anionic agent (i.e. 0 wt % of the anionic agent) in the composition of the present invention, means that the composition comprises no anionic agent at all.

The softening composition of the present invention may notably comprise at least:

a) 1-10% wt of an amphoteric surfactant of formula (VII);

b) 0.1-5% wt of an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl; weight ratio of compound a) to compound b) is comprised between 1:2 and 20:1;

c) 0.01-2% wt of a polysaccharide or polysaccharide derivative; weight ratio of compound a) to compound c) is comprised between 3:1 and 30:1; and d) water.

Preferably, the softening composition of the present invention may notably comprise at least:

a) 1-10% wt of an amphoteric surfactant of formula (VII);

b) 0.1-5% wt of an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl; weight ratio of compound a) to compound b) is comprised between 1:2 and 20:1;

c) 0.01-2% wt of a guar or guar derivative; weight ratio of compound a) to compound c) is comprised between 3:1 and 30:1; and d) water;

wherein the softening composition is substantially free or completely free of anionic agent.

In one embodiment, the softening composition of the present invention consists of:

a) 1-10% wt of an amphoteric surfactant of formula (VII);

b) 0.1-5% wt of an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl; weight ratio of compound a) to compound b) is comprised between 1:2 and 20:1;

c) 0.01-2% wt of a guar or guar derivative; weight ratio of compound a) to compound c) is comprised between 3:1 and 30:1; and d) water.

In one embodiment, the present invention provides a softening system consisting of:

a) an amphoteric surfactant carrying a $C_{12}$-$C_{22}$-alkyl or $C_{12}$-$C_{22}$-alkenyl;

b) an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl;

weight ratio of compound a) to compound b) is comprised between 1:2 and 20:1, and c) a polysaccharide or polysaccharide derivative; weight ratio of compound a) to compound c) is comprised between 3:1 and 30:1.

In one preferred embodiment, the present invention provides a softening system consisting of:

a) an amphoteric surfactant carrying a $C_{16}$-$C_{20}$-alkyl or $C_{16}$-$C_{20}$-alkenyl;

b) an alcohol compound carrying a $C_{10}$-$C_{22}$-alkyl or $C_{10}$-$C_{22}$-alkenyl and/or a carboxylic acid compound carrying a $C_{10}$-$C_{22}$-alkyl or $C_{10}$-$C_{22}$-alkenyl;

weight ratio of compound a) to compound b) is comprised between 1:2 and 20:1, and c) a polysaccharide or polysaccharide derivative; weight ratio of compound a) to compound c) is comprised between 3:1 and 30:1.

The softening system is preferably mixed with a suitable liquid carrier which may be selected from water, organic solvents and mixtures thereof.

For optimum phase stability of these compositions, the neat pH, measured at 20° C., may be in the range of from 3 to 8. Typical levels of the fabric softener within the softening compositions are 0.1% to 30% by weight, preferably from 1% to 20% by weight. The pH of these compositions herein can be regulated by the addition of acids such as Bronsted or Lewis ones. Examples of suitable acids include the inorganic mineral acids, carboxylic acids, in particular the low molecular weight ($C_1$-$C_5$)-carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids. Especially preferred is citric acid.

The softening composition may also comprise other fabric softeners classically used, such as for example quaternary ammonium salts, particularly dialkyl quats or ester quats. Fabric softeners tend to be based on quaternary ammonium salts with one or two long alkyl chains, a typical compound being dipalmitoylethyl hydroxyethylmonium methosulfate. Other cationic compounds can be derived from imidazolium, substituted amine salts, or quaternary alkoxy ammonium salts. One of the most common compounds of the early formulations was dihydrogenated tallow dimethyl ammonium chloride (DHTDMAC). There are three main types of quaternary ammonium compounds used in the formulation of household fabric softeners: dialkyldimethyl ammonium compounds, diamido alkoxylated ammonium compounds, and imidazolinium compounds.

Softeners that may be used in combination with the amphoteric surfactant of the present invention are preferably quaternary ammonium softeners such as:

TET: Di(tallowcarboxyethyl)hydroxyethyl methyl ammonium methylsulfate

TEO: Di(oleocarboxyethyl)hydroxyethyl methyl ammonium methylsulfate,

TES: Distearyl hydroxyethyl methyl ammonium methylsulfate,

TEHT: Di(hydrogenated tallow-carboxyethyl)hydroxyethyl methyl ammonium methylsulfate, and TEP: Di(palmiticcarboxyethyl)hydroxyethyl methyl ammonium methylsulfate In a preferred embodiment of the present invention the composition comprises less than 1 wt %, preferably less than 0.5 wt %, more preferably less than 0.1 wt %, of further fabric softener(s) except the compounds a), b) and c). More preferably, the composition does not comprise a further fabric softener except the compounds a), b) and c).

The composition may notably comprise less than 1 wt %, preferably less than 0.5 wt %, more preferably less than 0.1 wt %, of quaternary ammonium salts, even more preferably, less than 0.01 wt % of the quaternary ammonium salts. In one embodiment, the composition does not comprise any quaternary ammonium salts.

One problem associated with the quaternary ammonium salts is that they may lead to "yellowing" of the fabrics. Hence, it is preferred that the softening composition of the present invention comprises only low level of the quaternary ammonium salts or the softening composition does not comprise any quaternary ammonium salts.

In referring to other optional components, without this having to be regarded as an exhaustive description of all possibilities, which, on the other hand, are well known to the person skilled in the art, the following may be mentioned:

a) other products that enhance the performance of the softening compositions, such as silicones, amine oxides, amphoteric surfactants, such as amphoacetate, nonionic surfactants such as polysorbate, polyglucoside derivatives, and cationic polymers such as polyquaternium, etc, b) stabilising products, such as salts of amines having a short chain, which are quaternised or non-quaternised, for example of triethanolamine, N-methyldiethanolamine, etc., and also non-ionic surfactants, such as ethoxylated fatty alcohols, ethoxylated fatty amines, polysorbate, and ethoxylated alkyl phenols; typically used at a level of from 0 to 15% by weight of the composition, c) products that improve viscosity control, for example inorganic salts, such as calcium chloride, magnesium chloride, calcium sulphate, sodium chloride, etc.; products which can be used to reduce viscosity in concentrated compositions, such as compounds of the glycol type, such as, ethylene glycol, dipropylene glycol, polyglycols, etc.; and thickening agents for diluted compositions, for example, polymers derived from cellulose, guar gum, etc, d) components for adjusting the pH, which is preferably from 4 to 6, such as any type of inorganic and/or organic acid, for example hydrochloric, sulphuric, phosphoric, citric acid etc, e) agents that improve soil release, such as the known polymers or copolymers based on terephthalate s, f) bactericidal preservative agents, g) other products such as antioxidants, colouring agents, perfumes, germicides, fungicides, anti-corrosive agents, anti-crease agents, opacifiers, optical brighteners, pearl lustre agents, etc.

The softening composition, such as the fabric softener composition, according to the invention, may take a variety of physical forms including liquid, liquid-gel, paste-like, foam in either aqueous or non-aqueous form, powder, granular and tablet forms. For better dispersability, a preferred form of the composition is a liquid form, and in the form of an aqueous dispersion in water. When in a liquid form, the composition may also be dispensed with dispensing means such as a sprayer or aerosol dispenser.

When in a liquid form, such a fabric softener composition may contain from 0.1% to 20% by weight of a fabric softening agent, in the case of standard (diluted) fabric softener but may contain higher levels from up to 30% or even 40% by weight in the case of very concentrated fabric softeners. The composition will usually also contain water and other additives, which may provide the balance of the composition. Suitable liquid carriers are selected from water, organic solvents and mixtures thereof. The liquid carrier employed in the instant compositions is preferably at least primarily water due to its low cost, safety, and environmental compatibility. Mixtures of water and organic solvent may be used. Preferred organic solvents are; monohydric alcohol, such as ethanol, propanol, iso-propanol or butanol; dihydric alcohol, such as glycol; trihydric alcohols, such as glycerol, and polyhydric (polyol) alcohols.

Liquid fabric softeners are customarily prepared by melting the softening ingredients and adding the melt to hot water, with agitation to disperse the water-insoluble ingredients.

The fabric softener composition according to the invention can be used in a so-called rinse process, where a fabric softener as defined above, is first diluted in an aqueous rinse bath solution. Subsequently, the laundered fabrics which have been washed with a detergent liquor and optionally rinsed in a first inefficient rinse step ("inefficient" in the sense that residual detergent and/or soil may be carried over with the fabrics), are placed in the rinse solution with the diluted composition. Of course, the fabric softener composition may also be incorporated into the aqueous bath once the fabrics have been immersed therein. Following that step, agitation is applied to the fabrics in the rinse bath solution causing the suds to collapse, and residual soils and surfactant is to be removed. The fabrics can then be optionally wrung before drying.

Accordingly, there is provided a method for rinsing fabrics, which comprises the steps of contacting fabrics, preferably previously washed in a detergent liquor, with a softening composition according to the invention. The subject-matter of the invention also includes the use of a fabric softener composition of the present invention to impart fabric softness to fabrics; notably for fabrics that have been washed in a high suds detergent solution, while providing in the rinse a reduction of suds or foaming and without the creation of undesirable flocs.

The present invention also concerns a method for softening a fabric comprising contacting an aqueous medium comprising the softening composition or the softening system of the invention with a fabric during a rinse cycle of a fabric washing machine.

This rinse process may be performed manually in basin or bucket, in a non-automated washing machine, or in an automated washing machine. When hand washing is performed, the laundered fabrics are removed from the detergent liquor and wrung out. The fabric softener composition of the present invention may be then added to fresh water and the fabrics are then, directly or after an optional inefficient first rinse step, rinsed in the water containing the composition according to the conventional rinsing habit. The fabrics are then dried using conventional means.

Should the disclosure of any patents, patent applications, and publications which are incorporated herein by reference conflict with the description of the present application to the extent that it may render a term unclear, the present description shall take precedence.

The following examples are included to illustrate embodiments of the invention. Needless to say, the invention is not limited to described examples.

Experimental Part

Material Information

Cocamidopropyl betaine (CAPB)

Cetyl betaine (CB)

Di(palmiticcarboxyethyl) hydroxyethyl methyl ammonium methylsulfate (TEP)

Guar 1: hydroxypropyl guar hydroxypropyltrimonium chloride with a Mw of 2 M, a degree of substitution (DS) of 0.10-0.13 and a charge density of 0.6-0.7 meq/g Jaguar HP-8: non-ionic hydroxypropyl guar provided by Solvay Jaguar S as natural guar gum provided by Solvay Sodium stearoamphoacetate (SS)

Kathon™ CG (CG) is a commercial perseverative

Fabric Softener Composition Preparation 1) add guar if there is any into molten fatty alcohol or acid if there is any and mixed well 2) add amphoteric surfactant into above mixture and mixed well 3) add hot water (75-80° C.) gradually with agitation until uniform 4) cool the above mixture to room temperature Fabrics that are tested in the experimental part are the following:

Broadcloth: 100% cotton fiber content/woven/Used for rewet method for water absorbency study Terry cloth: 100% cotton fiber content/looped file construction/Used for all of the other evaluation methods I. Pre Treatment, Drying and Softener Treatment Procedure:

1) Fabric Pretreatment Method

Washing machine model: ELBA EWF 625

Surfactant: SLS (28% active)

Dosage of detergent: 10.0 g/10 pieces of cotton towel (0.6 kg)

Washing mode: 1 main wash, 3 rinses, empty and 1 spin

Wash temperature: 25° C.

2) Drying of Fabric

All fabric will be hanging dried in humidity room (Temp @20±1.0° C. and humidity @55±3%) for overnight to let fabric dry and equilibrate efficiently before further use.

3) Fabric Treatment

Dosage of softener: 1.0 wt. % Softener formulation in deionized water Soaking time: 30 min Temperature: 25° C.

Non-rinsing and hanging dry in humidity room

II. Results and Properties

1) Softness by Incline Method

Incline Method:

Chinese National Standard Softener Evaluation Method GB/T 18318.1-2009 Textiles-determination of bending behavior-Part 1: Incline method.

Results for softness comparisons by incline method are mentioned in Table 1 and Table 2, the shorter bending length, the better the softness.

TABLE 1

| Formulation | Bending length (mm) |
|---|---|
| CB: 5 wt % | 33.6 |
| TEP: 5 wt % | 30.9 |
| CB:palmitic acid (weight ratio) 5:0.5 | 31.7 |
| CB:palmityl alcohol (weight ratio) 5:0.1 | 31.6 |
| CB:palmityl alcohol (weight ratio) 5:0.5 | 30.2 |
| SS: 5 wt % | 33.5 |
| SS:palmitic acid (weight ratio) 5:0.5 | 31 |
| SS:palmityl alcohol (weight ratio) 5:0.1 | 31 |
| SS:palmityl alcohol (weight ratio) 5:0.5 | 30.1 |
| CB: 2.1 wt % | 29.9 |
| Guar 1: 0.1 wt % | |
| Palmityl alcohol: 1.4 wt % | |
| SS: 2.1 wt % | 30.1 |
| Guar 1: 0.1 wt % | |
| Palmityl alcohol: 1.4 wt % | |

It appears then that compositions according to the present invention provide a sufficient good softness even while decreasing the amount of softener within the compositions.

TABLE 2

| Formulation | Bending length (mm) |
|---|---|
| CB: 5 wt % | 29.6 |
| CG: 0.1 wt % | |
| CAPB: 5 wt % | 32.3 |
| CG: 0.1 wt % | |

It can be seen that the composition containing CB ($C_{16}$) provided better softening performance compared to that containing CAPB ($C_{12}$).

2) Softness by Sensorial Tests

Sensorial Test Method:

revised ASTM D5237-05 standard guide for evaluating fabric softener. Blank was set as control with softness ranking of 0, which means the hardest. Another fabric was treated with another type of softener EAQ with softness ranking of 5 as a control, which means the softest.

Results for softness comparisons by sensorial test method with 6 panelists are mentioned in Tables 3 to 5.

TABLE 3

| Formulation | Average Value |
|---|---|
| CB: 2 wt % | 2.5 |
| CB: 2 wt % | 3.0 |
| Guar 1: 0.1 wt % | |
| Guar 1: 0.1 wt % | 0.0 |
| TEP: 2 wt % | 4.0 |
| CB:palmitic acid (weight ratio) 5:0.5 | 3.5 |
| CB:palmityl alcohol (weight ratio) 5:0.1 | 3.2 |
| CB:palmityl alcohol (weight ratio) 5:0.5 | 3.8 |
| SS: 2 wt % | 2.5 |
| SS:palmitic acid (weight ratio) 5:0.5 | 3.5 |
| SS:palmityl alcohol (weight ratio) 5:0.1 | 3.3 |
| SS:palmityl alcohol (weight ratio) 5:0.5 | 4 |
| CB: 2.1 wt % | 4.25 |
| Guar 1: 0.1 wt % | |
| Palmityl alcohol: 1.4 wt % | |
| SS: 2.1 wt % | 4 |
| Guar 1: 0.1 wt % | |
| Palmityl alcohol: 1.4 wt % | |

It can be seen in Table 3 that compositions according to the present invention provide an improvement of softness properties in comparison with classical formulations. Surprising effect is that the addition of guar in the formulations of the present invention permits to improve the softness properties while guar alone demonstrates absolutely no significant effect on this property.

TABLE 4

| Softener (in water) | Softening effect Average Value |
|---|---|
| CB: 2 wt % | 2.50 |
| Jaguar S: 0.1 wt % | |
| CB: 2 wt % | 2.75 |
| Jaguar HP 8: 0.1 wt % | |
| CB: 2 wt % | 3.00 |
| Guar 1: 0.1 wt % | |
| CB: 2.1 wt % | 4.25 |
| Jaguar S: 0.1 wt % | |
| Palmityl alcohol: 1.4 wt % | |
| CB: 2.1 wt % | 4.25 |
| Jaguar HP8: 0.1 wt % | |
| Palmityl alcohol: 1.4 wt % | |

TABLE 4-continued

| Softener (in water) | Softening effect Average Value |
|---|---|
| CB: 2.1 wt %<br>Guar 1: 0.1 wt %<br>Palmityl alcohol: 1.4 wt % | 4.25 |

It can be seen in Table 4 that improvement of softness properties is reached by the use of different guars within the compositions of the invention.

TABLE 5

| Formulation | Average Value |
|---|---|
| CB: 5 wt %<br>CG: 0.1 wt % | 2.9 |
| CAPB: 5 wt %<br>CG: 0.1 wt % | 1.0 |

It can be seen in Table 5 that the composition containing CB ($C_{16}$) imparted higher softness to the fabric compared to that containing CAPB ($C_{12}$).

3) Water Absorbency

Water Absorbency Ability Evaluation by Rewet Method: revised ASTM D5237-05 standard guide for evaluating fabric softener Results for water absorbency are mentioned in Table 6.

TABLE 6

| Formulation | Water migration in height (mm) |
|---|---|
| CB: 2 wt %<br>Guar 1: 0.1 wt % | 76.0 |
| CB: 2 wt %<br>Guar 1: 0.1 wt % | 75.0 |
| TEP: 2 wt % | 53.5 |
| CB:palmitic acid (weight ratio) 5:0.5 | 67.0 |
| CB:palmityl alcohol (weight ratio) 5:0.1 | 70.0 |
| CB:palmityl alcohol (weight ratio) 5:0.5 | 66.0 |
| SS: 2 wt % | 75.0 |
| SS:palmitic acid (weight ratio) 5:0.5 | 65 |
| SS:palmityl alcohol (weight ratio) 5:0.1 | 69 |
| SS:palmityl alcohol (weight ratio) 5:0.5 | 63 |
| CB: 2.1 wt %<br>Guar 1: 0.1 wt %<br>Palmityl alcohol: 1.4 wt % | 62 |
| SS: 2.1 wt %<br>Guar 1: 0.1 wt %<br>Palmityl alcohol: 1.4 wt % | 60 |

It can be seen in Table 6 that compositions according to the present invention provide a better water absorbency than pure ester quats (TEP) system, that is beneficial for consumers.

4) Fluffiness Evaluation

Softener treated fabric strips in certain size were stacked layer by layer. A light weight (100.0 g) and a heavy weight (550.0 g) were applied on top of the stacked layer of strips and the height of the stack of strips is measured after 15 seconds as T100 g and T550 g respectively. The bigger the difference of the stack height under light and heavy weight, the more fluffy the fabric strip is.

$$\text{Fluffiness } \% = (T100\text{ g} - T550\text{ g})/T550\text{ g} * 100\%$$

Fluffiness rating formulation:

Layer by layer method apparatus: Layer number: 15 layers/Sample Size: 50±1 mm in width and 80±1 mm in length/Light weight: 100.0 g weight standard/Heavy weight: 550.0 g weight standard.

Results for fluffiness evaluation are mentioned in Tables 7 and 8.

TABLE 7

| Formulation | Flufiness (%) |
|---|---|
| CB: 2 wt %<br>Guar 1: 0.1 wt % | 28.2 |
| CB: 2 wt %<br>Guar 1: 0.1 wt % | 28.3 |
| TEP: 2 wt % | 25.1 |
| CB:palmitic acid (weight ratio) 5:0.5 | 28.5 |
| CB:palmityl alcohol (weight ratio) 5:0.1 | 28.3 |
| CB:palmityl alcohol (weight ratio) 5:0.5 | 28.2 |
| SS: 2 wt % | 28.4 |
| SS:palmitic acid (weight ratio) 5:0.5 | 28.2 |
| SS:palmityl alcohol (weight ratio) 5:0.1 | 28.3 |
| SS:palmityl alcohol (weight ratio) 5:0.5 | 28.2 |
| CB: 2.1 wt %<br>Guar 1: 0.1 wt %<br>Palmityl alcohol: 1.4 wt % | 28.5 |
| SS: 2.1 wt %<br>Guar 1: 0.1 wt %<br>Palmityl alcohol: 1.4 wt % | 28.6 |

It can be seen in Table 7 that compositions according to the present invention provide an improved fluffiness in comparison with formulations that do not comprise guars.

TABLE 8

| Formulation | Flufiness (%) |
|---|---|
| CB: 5 wt %<br>CG: 0.1 wt % | 28.2 |
| CAPB: 2.1 wt %<br>CG: 0.1 wt % | 22.9 |

It can be seen in Table 8 that the composition containing CB ($C_{16}$) provided higher fluffiness in comparison with that contains CAPB ($C_{12}$).

The invention claimed is:

1. A method for softening a fabric comprising the step of contacting an aqueous medium comprising a softening composition with a fabric during a rinse cycle of a fabric washing machine, the softening composition comprising at least:

a) 1-10% wt of a betaine having the structure:

$$R^1R^2R^3N^+(CH_2)_yC(O)O^- \quad (I)$$

wherein $R^1$ is methyl, $R^2$ is a $C_{16}$-alkyl, $R^3$ is methyl, and y is 2;

b) 0.1-5% wt of an alcohol compound carrying a $C_{14}$-alkyl; the weight ratio of compound a) to compound b) is comprised between 1:2 and 20:1;

c) 0.01-2% wt of hydroxypropyl guar hydroxypropyltrimonium chloride; the weight ratio of compound a) to compound c) is comprised between 3:1 and 30:1; and d) water;

wherein the percent by weight is expressed in relation with the total weight of the softening composition.

2. The method according to claim 1, wherein the softening composition is substantially free or completely free of anionic agent.

3. The method according to claim 1, wherein the softening composition comprises less than 1 wt % of quaternary ammonium salt.

4. The method according to claim 1, wherein the softening composition comprises less than 0.01 wt % of the quaternary ammonium salt.

5. A method for softening a fabric comprising the step of contacting an aqueous medium comprising a softening system with a fabric during a rinse cycle of a fabric washing machine, the softening system consisting of:

a) a betaine having the structure:

$$R^1R^2R^3N^+(CH_2)_yC(O)O^- \quad (I)$$

wherein $R^1$ is methyl, $R^2$ is a $C_{16}$-alkyl, $R^3$ is methyl, and y is 2;

b) an alcohol compound carrying a $C_{14}$-alkyl; the weight ratio of compound a) to compound b) is comprised between 1:2 and 20:1; and c) hydroxypropyl guar hydroxypropyltrimonium chloride; the weight ratio of compound a) to compound c) is comprised between 3:1 and 30:1.

* * * * *